US007325766B1

(12) United States Patent
Schunck

(10) Patent No.: US 7,325,766 B1
(45) Date of Patent: Feb. 5, 2008

(54) AUTOMATIC BOBBIN WINDER SYSTEM

(76) Inventor: Robert J. Schunck, 711 41st Ave. NE., St. Petersburg, FL (US) 33703

( * ) Notice: Subject to any disclaimer, the term of this patent is extended or adjusted under 35 U.S.C. 154(b) by 241 days.

(21) Appl. No.: 11/166,421

(22) Filed: Jun. 24, 2005

(51) Int. Cl.
*B65H 54/00* (2006.01)

(52) U.S. Cl. ..... 242/485.7; 242/484.8; 242/419.4; 242/149

(58) Field of Classification Search ..... 242/484.8, 242/485.7, 486.6, 419.4, 577.1, 571.5, 149, 242/588, 390, 1, 405, 484.7; 112/279, 302
See application file for complete search history.

(56) References Cited

U.S. PATENT DOCUMENTS 1,674,285 A * 6/1928 Harvey ..... 242/571.5
4,988,048 A * 1/1991 Lochbronner ..... 242/485.7
5,042,735 A 8/1991 Vogel et al.
5,560,557 A * 10/1996 Horvath et al. ..... 242/149
5,816,512 A * 10/1998 Nakashima et al. ..... 242/484.7
5,865,394 A 2/1999 Giese et al.
6,036,136 A 3/2000 Bobo
6,578,787 B2 * 6/2003 Yonenoi ..... 242/419.4

* cited by examiner

*Primary Examiner*—Peter M. Cuomo
*Assistant Examiner*—William E Dondero

(57) ABSTRACT

A housing has major and minor surfaces creating major and minor chambers. A motor secured within the minor chamber has a drive shaft extending upwardly through the minor surface. A power source is within the major chamber. Electrical components control the motor.

2 Claims, 3 Drawing Sheets

FIG 1
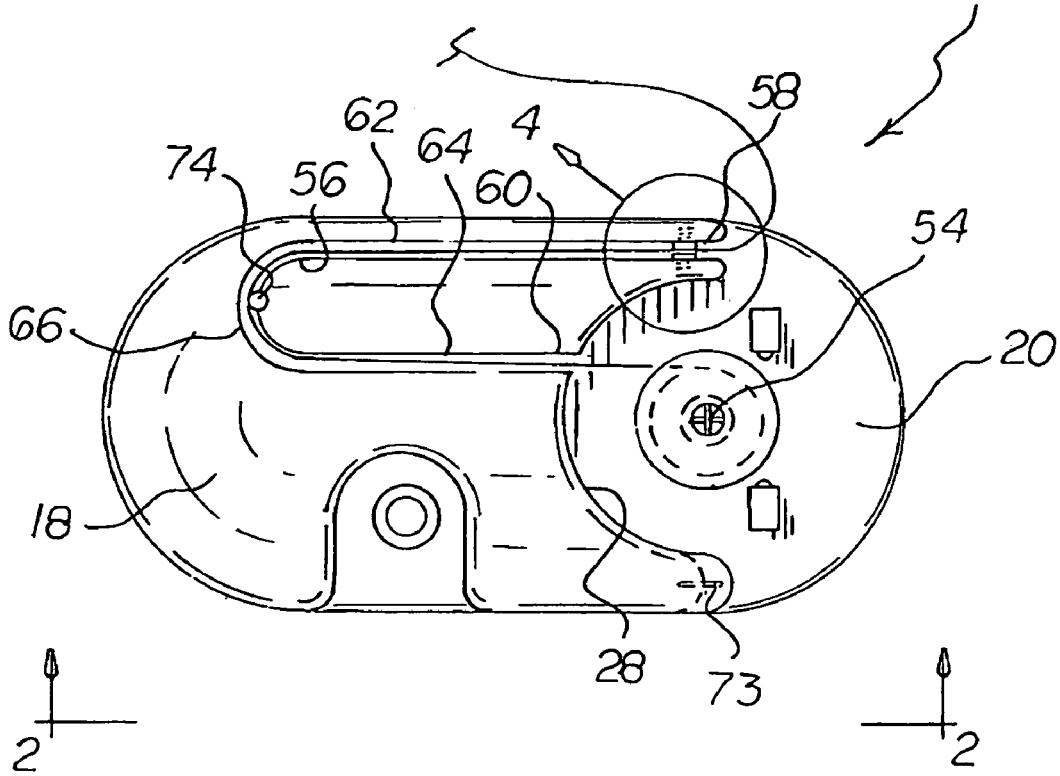
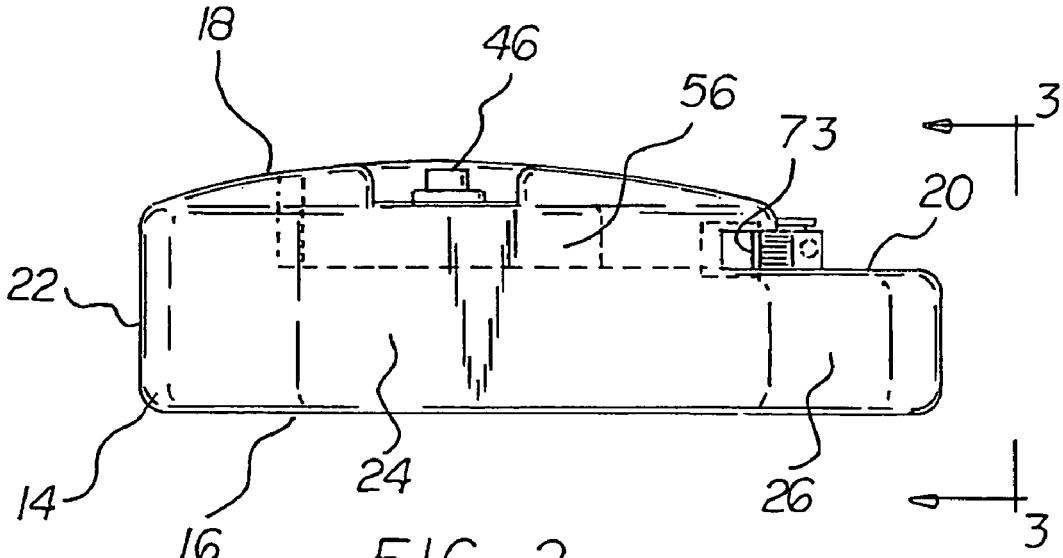
FIG 2

FIG 3
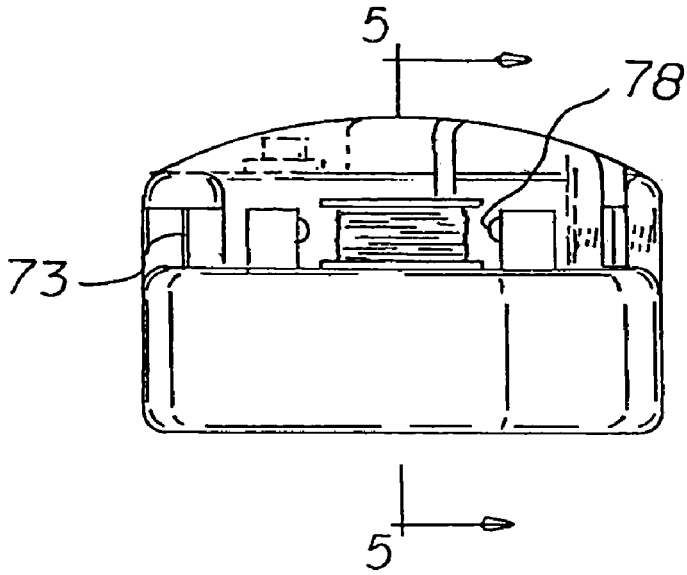
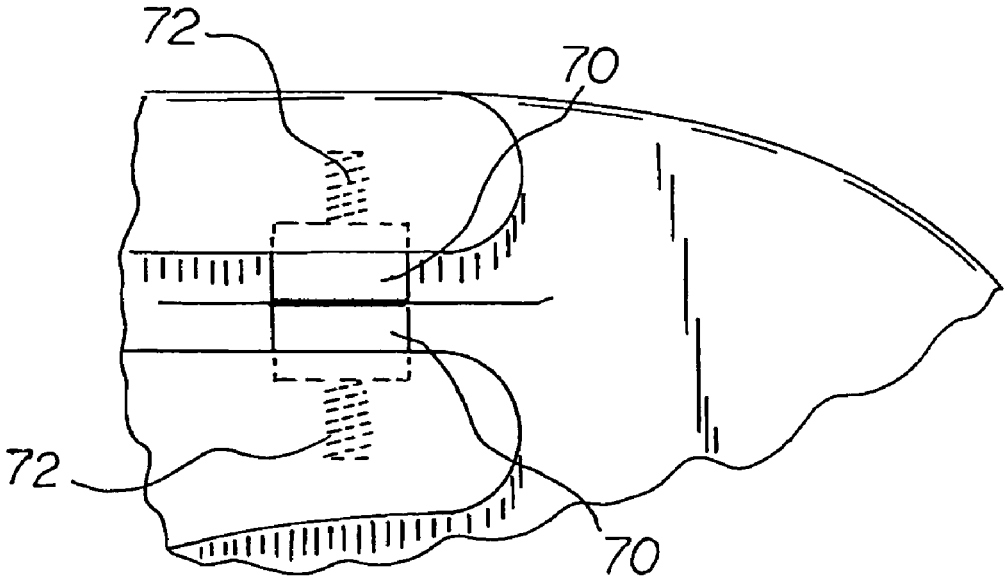
FIG 4

FIG 5
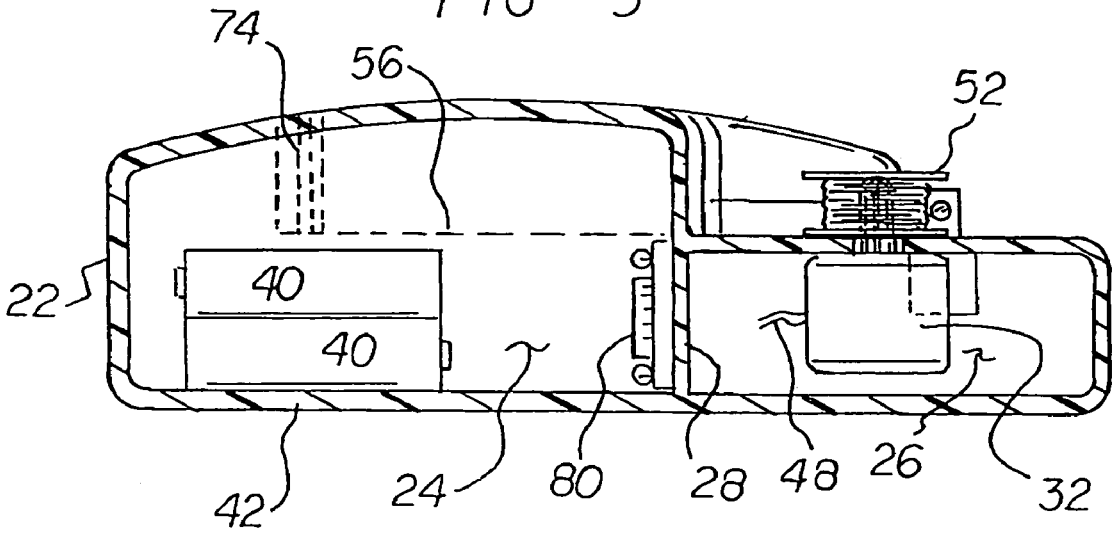
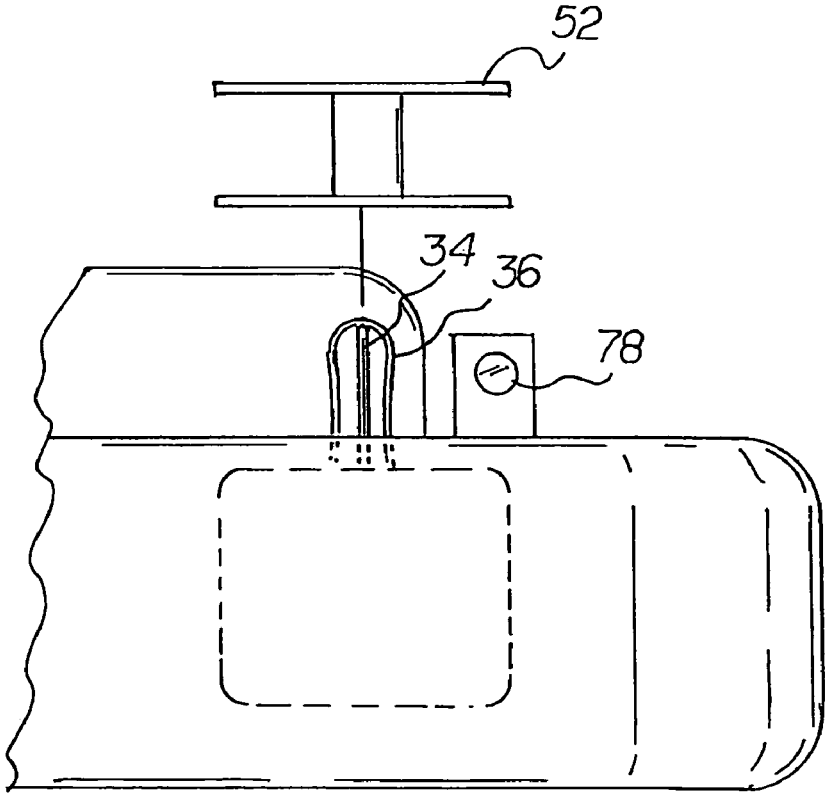
FIG 6

AUTOMATIC BOBBIN WINDER SYSTEM

The automatic bobbin winder system according to the present invention substantially departs from the conventional concepts and designs of the prior art, and in doing so provides an apparatus primarily developed for the purpose of replenishing a bobbin in a safe and economical manner without unthreading a sewing machine.

Therefore, it can be appreciated that there exists a continuing need for a new and improved automatic bobbin winder system which can be used for replenishing a bobbin in a safe and economical manner without unthreading a sewing machine. In this regard, the present invention substantially fulfills this need.

SUMMARY OF THE INVENTION

In view of the foregoing disadvantages inherent in the known types of bobbin winders of known designs and configurations now present in the prior art, the present invention provides an improved automatic bobbin winder system. As such, the general purpose of the present invention, which will be described subsequently in greater detail, is to provide a new and improved automatic bobbin winder system and method which has all the advantages of the prior art and none of the disadvantages.

To attain this, the present invention essentially comprises an automatic bobbin winder system. First provided is a housing. The housing has a lower flat base. The lower flat base is in a generally oval configuration. The housing has a major axis and a minor axis. The housing has an upper major surface provided at one end above the lower flat base at a first distance. The housing has an upper minor surface at another end above the upper major surface at a second distance. The second distance is less than the first distance. The housing also has a periphery. The periphery couples the base with the major and minor surfaces. A wall creates and separates a major chamber and a minor chamber. The wall has a center of curvature at the center of curvature of the periphery at the end of the major axis there adjacent.

A motor is provided. The motor is secured within the minor chamber. The motor has a drive shaft. The drive shaft extends upwardly through the minor surface. The drive shaft above the minor surface has an inverted U-shaped spring.

Provided next is a pair of batteries. The batteries are removably secured within the major chamber. A removable panel is provided in the housing. In this manner a user is permitted access to the batteries for repair and replacement.

Electrical components are provided. The electrical components include a button. The button is mounted on the major surface. The button has associated wires. The wires couple the button, the motor and the batteries. In this manner a user is allowed to selectively depress the button for energizing and de-energizing the motor to selectively rotate and stop the rotating of the drive shaft.

A removable bobbin is provided next. The bobbin is positioned on the drive shaft and the U-shaped spring. The bobbin is provided above the minor surface. In this manner the bobbin may be rotated and a bobbin thread is wound thereon with the activation of the motor.

A generally U-shaped channel is formed in the major surface. The channel extends downwardly to a depth adjacent to the minor surface. The channel has an input end. The input end is laterally offset from the axis of rotation above the wall in proximity to the periphery. The channel has an output end. The output end is above the wall in proximity to the major axis. The channel has a first linear extent. The first linear extent begins at the input end. The channel has a second linear extent. The second linear extent ends at the output end. A semi-circular extent is provided between the first and second linear extents.

Further provided are thread guides. The thread guides include a pair of elastomeric pads. The pads are provided in the channel adjacent to the input end. In this manner a restrictive force is applied to a thread being pulled there through. The pads have associated coil springs. The coil springs are adapted to exert a force to the pads and thread there between. The guides also include a cylindrical post. The post is provided at the midpoint of the semi-circular extent of the channel. In this manner thread may be guided.

Provided last are electronic sensors. The electronic sensors are mounted on the minor surface laterally offset from the bobbin. In this manner the presence of wound thread on the bobbin is detected. Electronic controls are provided. The electronic controls couple the sensors, motor and batteries. In this manner the motor is inactivated upon a predetermined quantity of thread having been received on the bobbin.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automatic bobbin winder system which has all of the advantages of the prior art bobbin winders of known designs and configurations and none of the disadvantages.

It is another object of the present invention to provide a new and improved automatic bobbin winder system which may be easily and efficiently manufactured and marketed.

It is further object of the present invention to provide a new and improved automatic bobbin winder system which is of durable and reliable constructions.

An even further object of the present invention is to provide a new and improved automatic bobbin winder system which is susceptible of a low cost of manufacture with regard to both materials and labor, and which accordingly is then susceptible of low prices of sale to the consuming public, thereby making such automatic bobbin winder system economically available to the buying public.

Even still another object of the present invention is to provide an automatic bobbin winder system for replenishing a bobbin in a safe and economical manner without unthreading a sewing machine.

Lastly, it is an object of the present invention to provide a new and improved automatic bobbin winder system. A housing has major and minor surfaces creating major and minor chambers. A motor secured within the minor chamber has a drive shaft extending upwardly through the minor surface. A power source is provided within the major chamber. Wires couple a button, the motor and the power source. A removable bobbin is positioned on the drive shaft. A channel is formed in the major surface for guiding thread to the bobbin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of an automatic bobbin winder system constructed in accordance with the principles of the present invention.

FIG. 2 is a front elevational view of the system shown in FIG. 1 taken along line 2-2 of FIG. 1.

FIG. 3 is a side elevational view of the system shown in FIGS. 1 and 2 taken along line 3-3 of FIG. 2.

FIG. 4 is an enlarged plan view of a portion of the system taken at circle 4 FIG. 1.

FIG. 5 is a cross sectional view of the system taken along line 5-5 of FIG. 3.

FIG. 6 is an enlarged exploded front elevational view of the bobbin and its support.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved automatic bobbin winder system embodying the principles and concepts of the present invention and generally designated by the reference numeral 10 will be described.

The present invention, the automatic bobbin winder system 10 is comprised of a plurality of components. Such components in their broadest context include a housing, a motor, a power source, a removable bobbin, and a channel. Such components are individually configured and correlated with respect to each other so as to attain the desired objective.

First provided is a housing 14. The housing has a lower flat base 16. The lower flat base is in a generally oval configuration. The housing has a major axis and a minor axis. The housing has an upper major surface 18 at one end above the lower flat base at a first distance. The housing has an upper minor surface 20 at another end above the upper major surface at a second distance. The second distance is less than the first distance. The housing also has a periphery 22. The periphery couples the base with the major and minor surfaces. A wall 28 creates and separates a major chamber 24 and a minor chamber 26. The wall has a center of curvature at the center of curvature of the periphery at the end of the major axis there adjacent.

A motor 32 is provided. The motor is secured within the minor chamber. The motor has a drive shaft 34. The drive shaft extends upwardly through the minor surface. The drive shaft above the minor surface has an inverted U-shaped spring 36. In an alternate embodiment, the inverted U-shaped spring is eliminated and the drive shaft is formed as a universal spindle 54 to accept a wide variety of bobbins. The spindle may have any one of a large number of currently available spindle designs, including straight, angled, split shaft, spring-loaded or friction spindles.

Provided next is a pair of batteries 40. The batteries are removably secured within the major chamber. A removable panel 42 is provided in the housing. In this manner a user is permitted access to the batteries for repair and replacement.

Electrical components are provided. The electrical components include a button 46. The button is mounted on the major surface. The button has associated wires 48. The wires couple the button, the motor and the batteries. In this manner a user is allowed to selectively depress the button for energizing and de-energizing the motor to selectively rotate and stop the rotating of the drive shaft.

A removable bobbin 52 is provided next. The bobbin is positioned on the drive shaft and the U-shaped spring. In an alternate embodiment the bobbin is positioned on the universal spindle. The bobbin is provided above the minor surface. In this manner the bobbin may be rotated and a bobbin thread is wound thereon with the activation of the motor.

A generally U-shaped channel 56 is formed in the major surface. The channel extends downwardly to a depth adjacent to the minor surface. The channel has an input end 58. The input end is laterally offset from the axis of rotation above the wall in proximity to the periphery. The channel has an output end 60. The output end is above the wall in proximity to the major axis. The channel has a first linear extent 62. The first linear extent begins at the input end. The channel has a second linear extent 64. The second linear extent ends at the output end. A semi-circular extent 66 is provided between the first and second linear extents.

Further provided are thread guides. The thread guides include a pair of elastomeric pads 70. The pads are provided in the channel adjacent to the input end. In this manner a restrictive force is applied to a thread being pulled there through. The pads have associated coil springs 72. The coil springs are adapted to exert a force to the pads and thread there between. The guides also include a cylindrical post 74. The post is provided at the midpoint of the semi-circular extent of the channel. In this manner thread may be guided.

Provided last are electronic sensors 78. The electronic sensors are mounted on the minor surface laterally offset from the bobbin. In this manner the presence of wound thread on the bobbin is detected. Electronic controls 80 are provided. The electronic controls couple the sensors, motor and batteries. In this manner the motor is inactivated upon a predetermined quantity of thread having been received on the bobbin. The electronics are configured to respond to and cut in the presence of underload, as well as overload, conditions.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automatic bobbin winder system for replenishing a bobbin in a convenient and economical manner without unthreading a sewing machine comprising, in combination:

a housing having a lower flat base and an upper surface with a periphery coupling the base with the upper surface to create a chamber;

a motor secured within the chamber with a rotatable drive shaft extending upwardly through the upper surface;

a battery removably secured within the chamber, the base consistituting a removable panel in the housing to permit access by a user to the battery for repair and replacement;

electrical components including a button mounted on the upper surface with associated wires coupling the button and the motor and the battery to allow a user to selectively depress the button for energizing and de-energizing the motor to selectively start and stop the rotating of the drive shaft;

removable bobbin positioned on the drive shaft above the minor surface for rotating to thereby wind a bobbin thread thereon with the starting of the motor;

a generally U-shaped path on the upper surface, the path having an input end and an output end with a first linear extent beginning at the input end and a second linear extent ending at the output end with a semi-circular extent there between; and thread guides including a pair of elastomeric pads along the path adjacent to the input end for applying a restrictive force to a thread being pulled there through, the pads having resiliency and adapted to exert a force to the pads and thread there between, the guides also including a cylindrical post adjacent the midpoint of the semi-circular extent of the channel for thread guiding purposes.

2. An automatic bobbin winder system for replenishing a bobbin in a convenient and economical manner without unthreading a sewing machine comprising, in combination:

a housing having a lower flat base in a generally oval configuration with a major axis and a minor axis and an upper major surface at one end there above at a first distance and an upper minor surface at another end there above at a second distance less than the first distance, the housing also having a periphery coupling the base with the major and minor surfaces to create a major chamber and a minor chamber with a wall separating the major and minor chambers, the wall having a center of curvature at the center of curvature of the periphery at the end of the major axis there adjacent;

a motor secured within the minor chamber with a drive shaft extending upwardly through the minor surface, the drive shaft above the minor surface having an inverted U-shaped spring for rotation therewith;

a pair of batteries removably secured within the major chamber with a removable panel in the housing to permit access by a user to the batteries for repair and replacement, electrical components including a button mounted on the major surface with associated wires coupling the button and the motor and the batteries to allow a user to selectively depress the button for energizing and de-energizing the motor to selectively start and stop the rotating of the drive shaft;

a removable bobbin positioned on the drive shaft and the U-shaped spring above the minor surface for rotating to thereby wind a bobbin thread thereon with the starting of the motor;

a generally U-shaped channel formed in the major surface extending downwardly to a depth adjacent to the minor surface, the channel having an input end laterally offset from the axis of rotation above the wall in proximity to the periphery, the channel having an output end above the wall in proximity to the major axis, the channel having a first linear extent beginning at the input end and a second linear extent ending at the output end with a semi-circular extent there between;

thread guides including a pair of elastomeric pads in the channel adjacent to the input end for applying a restrictive force to a thread being pulled there through, the pads having associated coil springs adapted to exert a force to the pads and thread there between, the guides also including a cylindrical post at the midpoint of the semi-circular extent of the channel for thread guiding purposes; and electronic sensors mounted on the minor surface laterally offset from the bobbin to detect the presence of thread wound on the bobbin with electronic controls coupling the sensors and motor and batteries to automatically inactivate the motor upon a predetermined quantity of thread having been received on the bobbin.

* * * * *